US008055160B2

(12) United States Patent
Bhattacharyya et al.

(10) Patent No.: US 8,055,160 B2
(45) Date of Patent: Nov. 8, 2011

(54) LIQUID ELECTROPHOTOGRAPHIC PRINTER

(75) Inventors: Manoj K. Bhattacharyya, Palo Alto, CA (US); Hou T. Ng, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 214 days.

(21) Appl. No.: 12/509,910

(22) Filed: Jul. 27, 2009

(65) Prior Publication Data

US 2011/0020036 A1 Jan. 27, 2011

(51) Int. Cl.
*G03G 15/10* (2006.01)

(52) U.S. Cl. ..... 399/237

(58) Field of Classification Search ..... 399/237, 399/296, 66, 264, 245
See application file for complete search history.

(56) References Cited

U.S. PATENT DOCUMENTS

| | | | | |
|---|---|---|---|---|
| 5,227,844 | A * | 7/1993 | Bhattacharjee et al. | 399/99 |
| 5,718,959 | A * | 2/1998 | Wieloch et al. | 428/58 |
| 7,400,850 | B2 | 7/2008 | Romem | |
| 7,685,692 | B2 * | 3/2010 | Rankin et al. | 29/426.4 |
| 2004/0052552 | A1 * | 3/2004 | Baker et al. | 399/249 |
| 2006/0286462 | A1 * | 12/2006 | Jackson et al. | 430/7 |
| 2008/0202369 | A1 * | 8/2008 | Yu et al. | 101/454 |
| 2008/0252680 | A1 | 10/2008 | Schmid et al. | |
| 2009/0080922 | A1 | 3/2009 | Yacoub et al. | |
| 2009/0258204 | A1 * | 10/2009 | Stein et al. | 428/211.1 |

FOREIGN PATENT DOCUMENTS

| | | |
|---|---|---|
| WO | WO 2007/018500 | 2/2007 |
| WO | WO 2008/127979 | 10/2008 |

* cited by examiner

*Primary Examiner* — David Porta
*Assistant Examiner* — Faye Boosalis

(57) ABSTRACT

The present disclosure is drawn to apparatuses, methods, and systems involving liquid electrophotographic printing. Generally, a liquid electrophotographic printer can comprise an ink application device that is configured to apply liquid electrophotographic ink to a substrate, and a roller having a tacky surface that removes excess material from the surface of the substrate thereby pretreating the substrate prior to receiving the liquid electrophotographic ink.

20 Claims, 5 Drawing Sheets

LIQUID ELECTROPHOTOGRAPHIC PRINTER

BACKGROUND

In many printing systems, it is common practice to develop a hardcopy of an image by using a photoconductive surface. The photoconductive surface is selectively charged with a latent electrostatic image having image and background areas. For example, a liquid developer comprising charged toner particles in a carrier liquid can be brought into contact with the selectively charged photoconductive surface. The charged toner particles adhere to the image areas of the latent image while the background areas remain clean. A hardcopy material (e.g. paper or other print substrate) is brought directly or indirectly into contact with the photo-conductive surface in order to transfer the latent image. Variations of this method utilize different ways for forming the electrostatic latent image on a photoreceptor or on a dielectric material.

BRIEF DESCRIPTION OF THE DRAWINGS

Additional features and advantages of the invention will be apparent from the detailed description which follows, taken in conjunction with the accompanying drawings, which together illustrate, by way of example, features of the invention.

Figure 1:
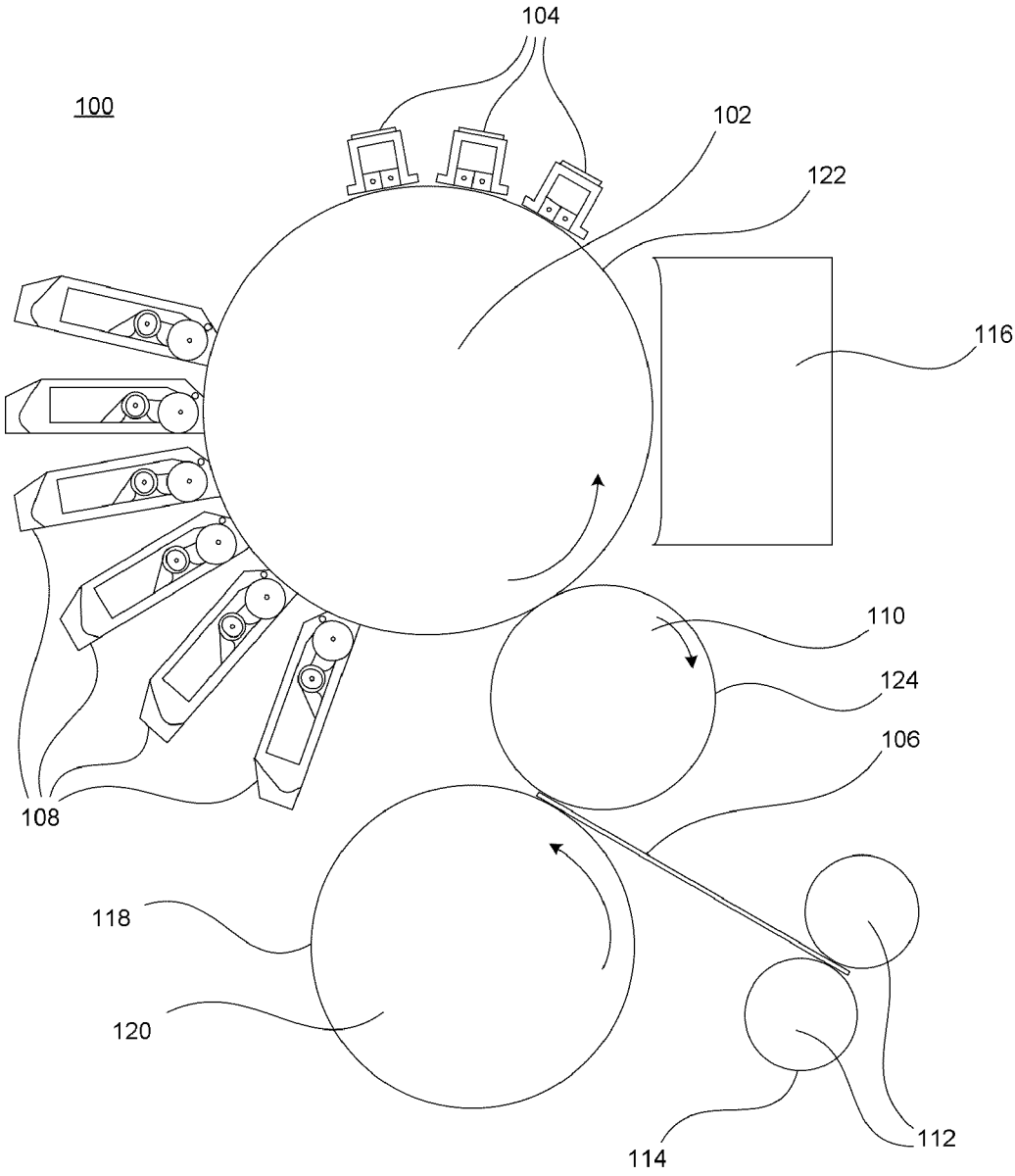
FIG. 1 is a general schematic of one possible print engine from a liquid electrophotographic printer in accordance with an embodiment of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

Before the present invention is disclosed and described, it is to be understood that this disclosure is not limited to the particular process steps and materials disclosed herein because such process steps and materials may vary somewhat. It is also to be understood that the terminology used herein is used for the purpose of describing particular embodiments only. The terms are not intended to be limiting because the scope of the present invention is intended to be limited only by the appended claims and equivalents thereof.

It is noted that, as used in this specification and the appended claims, the singular forms "a," "an," and "the" include plural referents unless the context clearly dictates otherwise.

As used herein, "liquid vehicle," "vehicle," or "liquid medium" refers to the fluid in which the colorant of the present disclosure can be dispersed to form a liquid electrophotographic ink. Such liquid vehicles and vehicle components are known in the art. Typical liquid vehicles can include but are not limited to a mixture of a variety of different agents, such as surfactants, co-solvents, buffers, biocides, sequestering agents, compatibility agents, antifoaming agents, oils, emulsifiers, viscosity modifiers, etc.

As used herein, "liquid electrophotographic ink" or "liquid toner" generally refers to an ink having a liquid vehicle, a colorant, a charging component, and polymer(s).

As used herein, "liquid electrophotographic printing" generally refers to the process that provides a liquid electrophotographic ink or ink toner image that is electrostatically transferred from a photo imaging plate to an intermediate drum or roller, and then thermally transferred to a substrate, or to the process wherein the ink image is electrostatically transferred from the photo imaging plate directly onto a substrate. Additionally, "liquid electrophotographic printers" generally refer to those printers capable of performing electrophotographic printing, as described above. These types of printers are different than traditional electrophotographic printers that utilized essentially dry charged particles to image a media substrate.

As used herein, "tackiness" refers to the adhesion between two substances. For example, the more tackiness there is between two substances, the more adhesion there is between the substances. To quantify "tackiness," it is useful to determine the "work of adhesion" as defined by IUPAC associated with the two substances. Generally speaking, the work of adhesion measures the amount of work necessary to separate two substances. Thus, the greater the work of adhesion associated with two substances, the greater the adhesion there is between the substances, meaning the greater the tackiness is between the two substances.

Work of adhesion and, thus, tackiness, can be quantified using acceptable techniques and methods generally used to measure adhesion, and is typically reported in units of force time (for example, gram seconds ("g·s")). For example, the TA-XT2 from Stable Micro Systems, Ltd. can be used to determine adhesion following the procedures set forth in the TA-XT2 Application Study (ref: MATI/PO.25), revised January 2000. According to this method, desirable values for work of adhesion for substantially tacky substances include at least about 0.5 g·s. As known in the art, other similar methods can be used on other similar analytical devices to determine adhesion.

As used herein, the term "about" is used to provide flexibility to a numerical range endpoint by providing that a given value may be "a little above" or "a little below" the endpoint. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not only the explicitly recited values of about 1 wt % to about 5 wt %, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

It has been recognized that it would be advantageous to develop a liquid electrophotographic printer having extended life of its intermediate transfer member or equivalent and having improved print performance over the life of the intermediate transfer member. In accordance with this, the present disclosure is drawn to liquid electrophotographic printers that can pretreat a substrate before printing on the substrate, as well as associated methods and systems involving such pretreatment. It is noted that when discussing a liquid electrophotographic printer, a system using such a printer, or a method of pretreating a substrate, each of these discussions can be considered applicable to each of these embodiments, whether or not they are explicitly discussed in the context of that embodiment. Thus, for example, in discussing a roller having a tacky surface for a liquid electrophotographic printer, such a roller can also be used in a method for pretreating a substrate or a system using the liquid electrophotographic printer, and vice versa.

As such, with these definitions in mind, a liquid electrophotographic printer can comprise an ink application device that is configured to apply liquid electrophotographic ink to a substrate, and a roller having a tacky surface that removes excess material from the surface of the substrate thereby pretreating the substrate prior to receiving the liquid electrophotographic ink.

Additionally, a method of pretreating a substrate for liquid electrophotographic printing can comprise removing excess material from the substrate prior to printing on the substrate by rolling a roller over the substrate, the roller including a tacky surface for removing the excess material.

Further, a liquid electrophotographic system for printing on a substrate can comprise a substrate, liquid electrophotographic ink, and a liquid electrophotographic printer as described herein.

The present apparatuses, methods, and systems unexpectedly provide improved printing performance. The present disclosure describes pretreatment of the substrate, which has been found to allow for longer run lengths of LEP printers while maintaining or often improving quality printing performance. Additionally, the life of the intermediate transfer member can be extended by 100% or more in some instances. In one embodiment, the intermediate transfer member life can be extended by 200%. In another embodiment, the intermediate transfer member life can be extended by 300%. While not intending to be bound by any particular theory, it is thought that the removal of excess material from the substrate can provide improved print quality as well as longer run time for printing before cleaning by lessening the wear of the surface of the intermediate transfer member.

Generally, the present disclosure contemplates the use of any intermediate transfer member known in the art. Additionally, the intermediate transfer member can be manufactured from any material as known in the art or comprise composite materials known in the art. In one embodiment, the intermediate transfer member can comprise a blanket as known in the art. The blanket can be manufactured from any material that allows transfer of liquid toner/liquid electrophotographic ink. In one embodiment, the blanket can be manufactured from a material selected from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof. Generally, the blanket can be a composite structure consisting of a multiple layers. As such, the topmost layer can also be manufactured from a material selected from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof.

Generally, the present disclosure also contemplates the use of any liquid electrophotographic printer having an ink application device. Further, the present liquid electrophotographic printers can have at least one pretreatment roller. Generally, the ink application device can be any device that allows for printing of liquid electrophotographic ink on a substrate. In one embodiment, the ink application device can comprises a photo imaging plate for forming an electrostatic image, a charging unit configured to charge at least a portion of the photo imaging plate forming a latent image, a binary image developer for applying a liquid toner or liquid electrophotographic ink to the latent image forming a developed image, an intermediate transfer member that receives the developed image, and an impression roller having a substrate that receives the developed image from the intermediate transfer member. Generally, the pretreatment roller can be a roller having a tacky surface that removes excess material from the surface of the substrate. In one embodiment, the pretreatment rollers can be made of or may include inexpensive disposable material. This can result in reduced cost of printing through prolonged life of the expensive intermediate transfer member.

The tacky surface can be any surface capable of removing excess material from a substrate. In one embodiment, the tacky surface can comprise a material selected from the group consisting of siloxanes, polydimethylsiloxanes, carbon-loaded polydimethylsiloxanes, high molecular weight siloxanes, fluoroelastomers, fluorosilicon elastomers, acrylic rubbers, latex polymers, derivatives thereof, and combinations thereof. In another embodiment, the tacky surface can have an adhesion of at least 0.5 g·s. Other levels of adhesion can be appropriate and can depend upon the substrate and/or the intermediate transfer member. As such, the adhesion can be at least 1.0 g·s, 2.0 g·s, 3.0 g·s, or even at least 5.0 g·s. Additionally, the tacky surface can be within 0.5 g·s of the surface of the intermediate transfer member. In one embodiment, the tacky surface can be within 0.2 g·s. In another embodiment, the tacky surface can have enough adhesion to remove 90% of the excess material from the substrate. In yet another embodiment, the tacky surface can remove 95%, or even 99%.

Generally, the excess material includes any material that is not rigidly affixed to the surface of the substrate. In one embodiment, the excess material can be selected from the group of lint, fillers, dirt, additives, cellulose including small size cellulose and regular size cellulose, and mixtures thereof. In another embodiment, the excess material includes any material that can be removed by a tacky surface having an adhesion of at least 0.5 g·s.

Generally, the apparatuses, systems, and methods described herein comprise at least one roller having a tacky surface that pretreats the substrate. However, the present disclosure is not limited to a single pretreatment roller. In one embodiment, the liquid electrophotographic printer can comprise a set of opposing rollers configured to pretreat multiple sides of the substrate prior to receiving the liquid electrophotographic ink. More specifically, both rollers can have the tacky surface that removes excess material from opposing surfaces of the substrate thereby pretreating both surfaces of the substrate prior to receiving the liquid electrophotographic ink. Alternately, it may be that only one of the opposing rollers has a tacky surface that removes excess material from a surface of the substrate thereby pretreating the surface of the substrate prior to receiving the liquid electrophotographic ink. As such, the present invention can be used for two-sided printing applications as well as one-sided printing applications, or can be used to pretreat both sides while only printing on one side, if desired. Generally, "opposing rollers" or a "set of opposing rollers" comprises two rollers where a first opposing roller is configured to roll over a first side of a substrate and a second opposing roller is configured to roll over a second side of the substrate. Additionally, the apparatuses, systems, and methods described herein can have multiple rollers that pretreat the same side of the substrate. As such, the present disclosure can be used with a multiplicity of rollers that pretreat one side or two sides of a substrate.

As described herein, the pretreatment can allow for longer run times as well as better print quality. The present disclosure can also allow for more efficient cleaning as the pretreatment rollers can be cleaned by water, solvent, wiping etc. thereby removing contaminants that could have migrated into a print engine of a liquid electrophotographic printer. As such, the present disclosure provides a means to lessen the complex and detailed cleaning of liquid electrophotographic printer print engines. In one embodiment, the cleaning of the pretreatment rollers can be by an aqueous solution, optionally having an organic co-solvent and a surfactant.

Referring to FIG. 1, a liquid electrophotographic (LEP) print engine 100 is shown in accordance with an embodiment of the disclosure. It is noted that the elements of FIG. 1 are not necessarily drawn to scale, nor does it represent every LEP design available for use herein, i.e. it provides merely an exemplary embodiment of an LEP printing system. In this embodiment, the LEP print engine 100 can form a latent image on a photo imaging plate (PIP) 102 by charging at least a portion of the PIP with charging units 104. The charging mechanism can include one or multiple unit charging subunit (not shown) followed by a laser discharging unit (not shown). Typically, the charging of the PIP corresponds to an image which can be printed by the LEP printing engine on a substrate 106. The latent image can be developed by liquid toner/liquid electrophotographic ink from binary image developers (BID) 108. The liquid electrophotographic ink adheres to the appropriately charged areas of the PIP developing the latent image thereby forming a developed image. The developed image can be transferred to an intermediate transfer member (ITM) 110. Additionally, the developed image can be heated on the ITM. The developed image can then be transferred to a substrate as described herein.

Prior to transferring the developed image to the substrate, the substrate can be pretreated by roller(s) 112 having a tacky surface 114. As discussed herein, the tacky roller(s) can remove excess material from the surface of the substrate prior to printing thereby extending the life of the ITM. While FIG. 1 shows two rollers 112, it is understood that the present figure only shows one exemplary embodiment of the present invention and that the present printers, systems, and methods can have one or more pretreatment rollers as described herein.

The PIP can be optionally discharged and cleaned by a cleaning/discharging unit 116 prior to recharging of the PIP in order to start another printing cycle. As the substrate passes by the ITM, the developed image located on the ITM can then be transferred to the substrate. Affixation of the developed image to the substrate can be facilitated by locating the substrate on the surface 118 of impression roller 120, which can apply pressure to the substrate by compressing it between the impression roller and the ITM as the image is being transferred to the substrate. Eventually, the substrate bearing the image exits the printer. In one embodiment, the printer can be a sheet-fed printer. In another embodiment, the printer can be a web-fed printer.

FIG. 1 shows a plurality of BID units located on the PIP. In one embodiment, each BID can contain a different colored liquid electrophotographic ink, for use in producing multicolor images. Generally, a colored liquid electrophotographic ink can be located in each of the other BID units. The present LEP printer can be a 1-shot process printer that transfers a complete multi-color image to the substrate at one time. For example, if an image is comprised of four color separations (e.g., black, cyan, magenta, and yellow), an exemplary mode of operation could involve charging the PIP with the appropriate pattern for the yellow electrophotographic ink. As the PIP rotates, the BID that contains yellow liquid electrophotographic ink can apply the toner onto the PIP surface 122, developing the latent image. The yellow electrophotographic ink image can then be transferred to the ITM surface 124 where it remains, awaiting the deposit of the remaining color layers, cyan, magenta and black. This cycle can be repeated for each of the remaining colors until a complete multi-colored image is located on ITM. Once the complete image is assembled, it can be deposited all at once onto the substrate. In another embodiment, the LEP printer can transfer each colored liquid electrophotographic ink to the substrate sequentially. Additionally, the LEP printer can include a BID that contains only a wetting substance, such as a carrier liquid used in the liquid electrophotographic ink, for example, or a volatile component thereof such as ISOPAR® L, to improve streaking.

The liquid electrophotographic inks or liquid toners described herein can be any such ink or toners known in the art. Generally, liquid electrophotographic inks can comprise a liquid vehicle, a colorant, a charging component, and, optionally, polymer(s). Additionally, other additive may be present in the liquid toner. One or more non-ionic, cationic, and/or anionic surfactant can be present, ranging from 0 wt % to 5.0 wt %. The balance of the formulation can be other liquid vehicle components known in the art, such as biocides, organic solvents, viscosity modifiers, and materials for pH adjustment, sequestering agents, preservatives, compatibility additives, emulsifiers, and the like.

EXAMPLES

The following examples illustrate embodiments of the disclosure that are presently known. Thus, these examples should not be considered as limitations of the invention, but are merely in place to teach how to make compositions of the present disclosure. As such, a representative number of compositions and their method of manufacture are disclosed herein.

Example 1

Comparison of Pretreated and Untreated LEP Substrates

Figure 2:
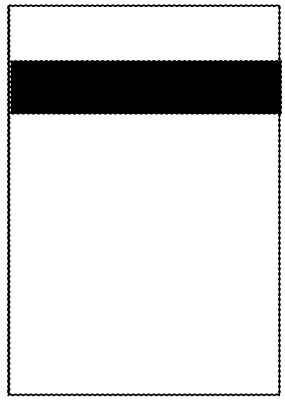
FIG. 2 is a representation of a solid rectangular print design used in accordance with an embodiment of the present disclosure.
Figure 3:
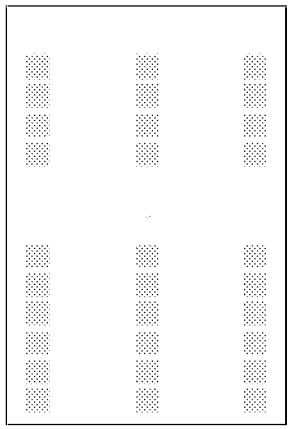
FIG. 3 is a representation of a monitoring print design used in accordance with an embodiment of the present disclosure.

An LEP printer was used to print two types of print designs on 60,000 Navajo Text Brilliant White uncoated papers. Specifically, a solid rectangular print design, as shown in FIG. 2, was printed on 59,988 sheets with a monitoring print design printed on every $5000^{th}$ sheet (12 sheets total). The monitoring print design is shown in FIG. 3, and has a series of gray squares, where each gray square consisted of many 10,000 small solid dots, each dot having ~50 μm in diameter.

Figure 4:
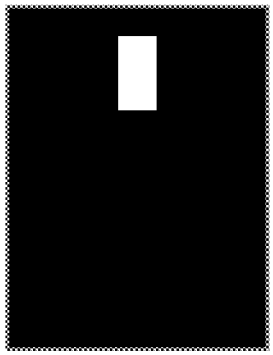
FIG. 4 is a representation of rectangular hole cut in the surface of a composite material used in conjunction with a pretreatment roller in accordance with an embodiment of the present disclosure.

The pretreatment roller included a composite material of polydimethylsiloxanes. A rectangular hole was cut in the surface of the composite material, as shown in FIG. 4, allowing for an untreated section of paper on which the liquid electrophotographic ink was printed, as well as a pretreated section on which the liquid electrophotographic ink was printed.

Figure 5:
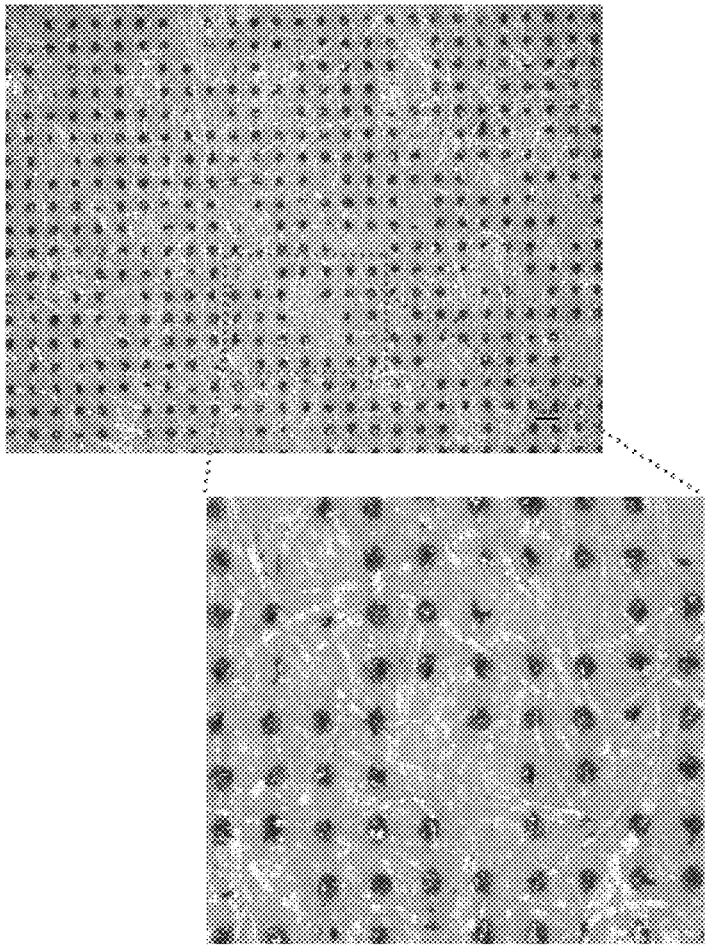
FIG. 5 is a microscopic picture showing the degradation of a printed area for an untreated substrate in accordance with an embodiment of the present disclosure.
Figure 6:
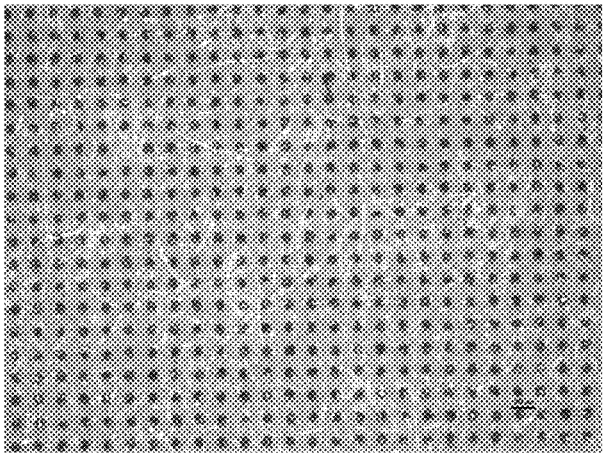
FIG. 6 is a microscopic picture of the printed area for a pretreated substrate in accordance with an embodiment of the present disclosure.

FIG. 5 shows the degradation of the printed area for a region of the paper that was not processed. The degradation is shown by missing as well as misshaped dots. FIG. 6 shows the printed area for a region of the paper that was pretreated. As can be seen in FIG. 6, the pretreated area retained print performance and showed substantially no signs of degradation.

Figure 7:
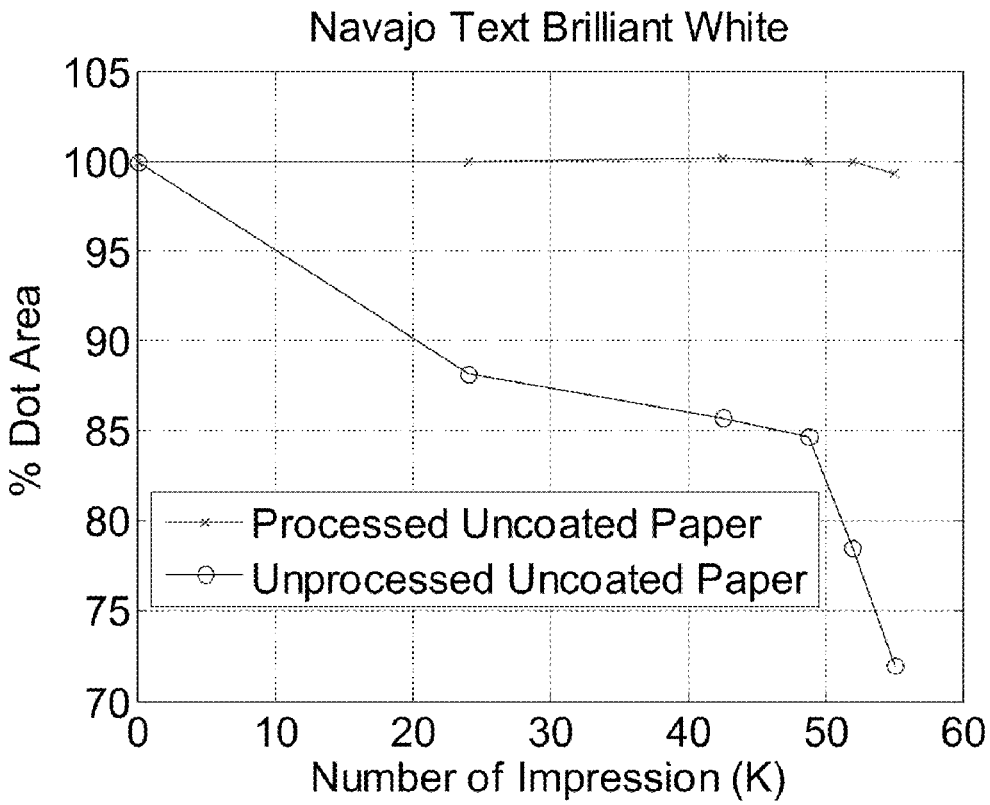
FIG. 7 is a graph of % Dot Area vs. Number of Impressions for pretreated and untreated printed areas of a substrate in accordance with an embodiment of the present disclosure.

FIG. 7, shows a graph of % Dot Area vs. Number of Impressions summarizing the results of the pretreated and untreated printed areas of the 60,000 Navajo Text Brilliant White uncoated paper. As shown in the graph, the present disclosure provides a means of achieving % dot area retention of over 95% after 50,000+ printings compared to untreated substrates that had less than 75% dot area after the same number of printings. Table I provides the raw data points for FIG. 7.

TABLE I

| | % Dot Area | |
|---|---|---|
| # of Sheets | Pretreated | Untreated |
| 0 | 100 | 100 |
| 24100 | 100 | 88 |
| 42600 | 100 | 86 |
| 48800 | 100 | 85 |
| 52000 | 100 | 79 |
| 55000 | 99 | 72 |

As such, in one embodiment, the present disclosure provides a manner of improving dot area % for LEP printing on a substrate by 20% after 52,000 prints. In another embodiment, the present disclosure provides a manner of improving dot area % for LEP printing on a substrate by 25% after 55,000 prints.

Figure 8:
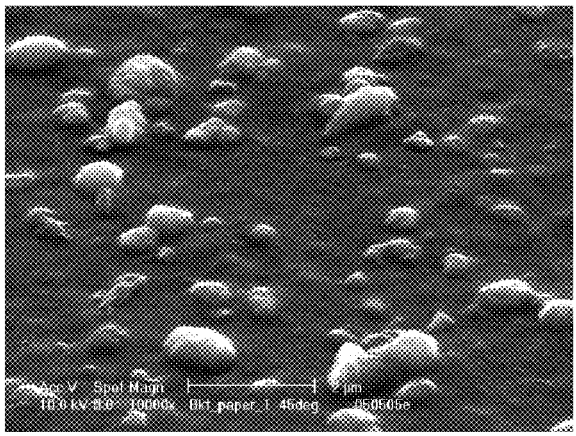
FIG. 8 is a scanning electron micrograph (SEM) image of pretreatment rollers after pretreating substrates in accordance with an embodiment of the present disclosure.
Figure 9:
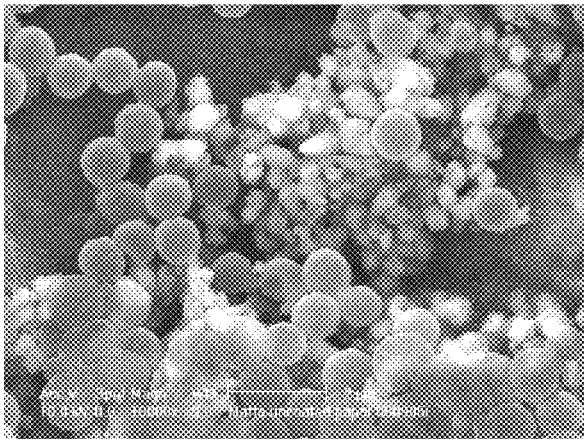
FIG. 9 is an SEM image of an untreated substrate in accordance with an embodiment of the present disclosure.

As described herein, pretreatment of the substrate can remove excess material from the substrate allowing for improved printing performance as well as improved intermediate transfer member life. As further evidence of the benefits of the use of pretreatment rollers, as shown in FIG. 9, an SEM image shows an untreated substrate containing excess material on its surface. Additionally, as shown in FIG. 8, an SEM image shows the present pretreatment rollers removal of these excess materials.

While the invention has been described with reference to certain preferred embodiments, those skilled in the art will appreciate that various modifications, changes, omissions, and substitutions can be made without departing from the spirit of the invention. It is intended, therefore, that the invention be limited only by the scope of the following claims.

What is claimed is:

1. A liquid electrophotographic printer, comprising:

a) an ink application device that is configured to apply liquid electrophotographic ink to a substrate, and b) a roller having a tacky surface that removes excess material from the surface of the substrate, thereby pretreating the substrate prior to receiving the liquid electrophotographic ink.

2. The liquid electrophotographic printer of claim 1, wherein the ink application device comprises:

a) a photo imaging plate for forming an electrostatic image;

b) a charging unit configured to charge at least a portion of the photo imaging plate forming a latent image;

c) a binary image developer for applying the electrophotographic ink to the latent image forming a developed image;

d) an intermediate transfer member that receives the developed image; and e) an impression roller having the substrate that receives the developed image from the intermediate transfer member.

3. The liquid electrophotographic printer of claim 2, wherein the intermediate transfer member comprises a blanket for receiving the developed image.

4. The liquid electrophotographic printer of claim 3, wherein the blanket is manufactured from a material from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof.

5. The liquid electrophotographic printer of claim 1, wherein the tacky surface comprises a material selected from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof.

6. The liquid electrophotographic printer of claim 1, wherein the tacky surface has an adhesion of at least 0.5 g·s.

7. The liquid electrophotographic printer of claim 1, wherein the excess material is selected from the group of lint, fillers, dirt, additives, cellulose, and mixtures thereof.

8. The liquid electrophotographic printer of claim 1, wherein the roller is one of a set of opposing rollers configured to pretreat the substrate prior to receiving the liquid electrophotographic ink.

9. The liquid electrophotographic printer of claim 8, wherein both of the opposing rollers have the tacky surface that removes excess material from opposing surfaces of the substrate, thereby pretreating multiple surfaces of the substrate prior to receiving the liquid electrophotographic ink.

10. The liquid electrophotographic printer of claim 8, wherein only one of the opposing rollers has a tacky surface that removes excess material from a surface of the substrate thereby pretreating the surface of the substrate prior to receiving the liquid electrophotographic ink.

11. A method of pretreating a substrate for liquid electrophotographic printing, comprising removing excess material from the substrate using a liquid electrophotographic printer prior to printing on the substrate by rolling a roller from the liquid electrophotographic printer over the substrate, the roller including a tacky surface for removing the excess material.

12. The method of claim 11, wherein the tacky surface comprises a material selected from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof.

13. The method of claim 11, wherein the tacky surface has an adhesion of at least 0.5 g·s.

14. The method of claim 11, wherein the roller is one of a set of opposing rollers, and each opposing roller is rolled over an opposing surface of the substrate.

15. The method of claim 14, wherein both opposing rollers have the tacky surface that removes excess material from opposing surfaces of the substrate prior to printing.

16. The method of claim 14, wherein only one of the opposing rollers has the tacky surface that removes excess material from a surface of the substrate prior to printing.

17. A liquid electrophotographic system for printing on a substrate, comprising:

a) a substrate;

b) liquid electrophotographic ink; and c) a liquid electrophotographic printer, comprising:

i) an ink application device that is configured to apply liquid electrophotographic ink to a substrate, and ii) a roller having a tacky surface that removes excess material from the surface of the substrate thereby pretreating the substrate prior to receiving the liquid electrophotographic ink.

18. The liquid electrophotographic system of claim 17, wherein the ink application device comprises:

a) a photo imaging plate for forming an electrostatic image;

b) a charging unit configured to charge at least a portion of the photo imaging plate forming a latent image;

c) a binary image developer for applying the electrophotographic ink to the latent image forming a developed image;

d) an intermediate transfer member that receives the developed image; and e) an impression roller having the substrate that receives the developed image from the intermediate transfer member.

19. The liquid electrophotographic system of claim 17, wherein the tacky surface comprises a material selected from the group of siloxanes, polydimethylsiloxanes, carbon-loaded polydimethylsiloxanes, high molecular weight siloxanes, fluoroelastomers, fluorosilicon elastomers, acrylic rubbers, latex polymers, combinations thereof, and derivatives thereof.

20. The liquid electrophotographic system of claim 17, wherein the tacky surface has an adhesion of at least 0.5 g·s.

* * * * *